US005718147A

United States Patent [19]

Clerc-Roch et al.

[11] Patent Number: 5,718,147

[45] Date of Patent: Feb. 17, 1998

[54] ELECTRIC STARTER FOR A MOTOR VEHICLE COMBUSTION ENGINE

[75] Inventors: Marie-Aline Clerc-Roch, Serpaize; Robert Jacquet, Villeurbanne, both of France

[73] Assignee: Valeo Equipements Electriques Moteur, Creteil, France

[21] Appl. No.: 547,675

[22] Filed: Oct. 18, 1995

[30] Foreign Application Priority Data

Oct. 18, 1994 [FR] France ..... 94 12513

[51] Int. Cl.[6] ..... F02N 11/00

[52] U.S. Cl. ..... 74/7 E; 74/7 A; 74/425; 74/120; 74/129.1

[58] Field of Search ..... 74/7 A, 7 E; 264/250, 264/255; 425/120, 121, 129.1, 570

[56] References Cited

U.S. PATENT DOCUMENTS

| | | | |
|---|---|---|---|
| 4,154,177 | 5/1979 | Mazzorana | 74/7 A |
| 4,489,018 | 12/1984 | Ball | 425/129.1 X |
| 4,495,825 | 1/1985 | Ruhle | 74/7 E |
| 4,561,316 | 12/1985 | Bolz et al. | 74/7 E |
| 4,649,285 | 3/1987 | Mazzorana . | |
| 5,341,697 | 8/1994 | Isozumi | 74/7 A |
| 5,473,956 | 12/1995 | Murata et al. | 74/7 E |
| 5,533,415 | 7/1996 | Ackermann et al. | 74/7 E |

FOREIGN PATENT DOCUMENTS

| | | |
|---|---|---|
| 0098992 | 1/1984 | European Pat. Off. . |
| 2410148 | 6/1979 | France . |
| 2555670 | 5/1985 | France . |

OTHER PUBLICATIONS

French Search Report dated 6 Jul. 1995.

*Primary Examiner*—Charles A. Marmor
*Assistant Examiner*—Troy Grabow
*Attorney, Agent, or Firm*—Morgan & Finnegan, L.L.P.

[57] ABSTRACT

An electric starter includes a metal base plate which supports the body of a starter head which is actuated by a lever articulated on an articulation support member. The articulation support member is carried by the base plate, on which it is formed by being molded in a plastics material. A crown having internal teeth is also molded on to the base plate in a plastics material, simultaneously with the molding of the support member. The support member and the toothed crown are two separate components, each formed in the mold from a separately injected, separate charge of plastics material.

6 Claims, 4 Drawing Sheets

ELECTRIC STARTER FOR A MOTOR VEHICLE COMBUSTION ENGINE

FIELD OF THE INVENTION

The present invention relates to electric starters, especially for combustion engines of motor vehicles.

BACKGROUND OF THE INVENTION

More particularly, the invention relates to a starter of the general type which is described and shown in French published patent specification No. FR 2 555 670A. This patent discloses a base plate, generally made in the form of a metallic plate which is profiled and perforated by press forming. The plate supports the casing of the electric motor for the starter and the body of a contactor which is arranged parallel to the electric motor. The plate also supports a starter head actuated by a lever which is articulated on an articulation support member. The articulation support member is carried by the base plate and formed by being molded on to the latter in a plastics material. The starter further including an epicyclic reduction gear train which is arranged between the starter motor and the shaft of the starter head to couple the latter to the starter motor. The gear train includes a crown having internal teeth made by molding in a plastics material on to the base plate. Each of two elements, namely the body of the articulation support member for the actuating lever and the body of the toothed crown, extends through at least one through hole formed in the base plate, to anchor the support member and the toothed crown to the base plate, with the support member and toothed crown being formed simultaneously by molding.

In the known design disclosed in the above mentioned French patent specification, the support member and the toothed crown together constitute a single component of plastics material. During the molding of this component on to the base plate, that part of the mold in which the support member is formed is fed with the plastics material through the appropriate holes in the base plate, from the part of the mold in which the toothed crown is to be formed, and into which the material is injected. In addition, the through holes in which the crown is anchored to the base plate consist of a set of small cylindrical holes, of which there is a very large number.

That design leads in some cases to very irregular flow of the plastics material during the molding operation. This in turn gives rise to major irregularities in the molded component, leading to prestressing of the component or even to faults occurring during the molding operation. Such prestressing can give rise to serious deformation of the toothed crown of the epicyclic gear train. FIG. 1 shows a starter 10, intended in particular for a motor vehicle combustion engine. This starter is made in accordance with the arrangements described in the French published patent specification No. FR 2 555 670A, and comprises a base plate 12 which serves as a support for the body 14 of the contactor of the starter. The contactor body 14 has an axial collar portion 16, which is fitted into a circular hole 18 formed in the upper part of the base plate 12.

The base plate 12 also serves for fastening of the casing 20 of the electric motor of the starter 10, for example by means of screws 22 which are secured into the casing 20, and which extend through the base plate 12 via holes 24 formed at the periphery of the lower part of the base plate 12. The hole 18 in the upper part of the latter is also surrounded by holes 26, whereby a cover plate 28 is secured by means of bolts 30 fastened through the holes 26.

Radially inwardly of the hole 18, and for fastening the body 14 of the contactor, the base plate 12, in the prior art arrangement which is shown in FIGS. 1 and 2, has a circular through hole 32. A tenon 34 of plastics material is made integrally with the body of an articulation support member 36 by being molded on to the base plate 12, and projects through the hole 32 in the latter. The contactor acts on an actuating lever 38, which displaces the starter head 40 of the starter so as to effect starting of the engine. This lever 38 is articulated on the support member 36.

The circular hole 32 is slightly flared or countersunk at 42 on the right hand face (in FIG. 1) of the base-plate 12, so that the free end of the tenon 34 can be upset into the countersink 42, thereby securely anchoring the support member 36 in place.

The base, or support, plate 12 has a circular through hole 44 at the center of its lower part (see FIG. 2). The secondary shaft 48 of an epicyclic gear train 50, interposed between the starter motor 20 and the starter head 40, is received in the hole 44, with a bush 46 being disposed in the hole 44 around the shaft 48.

The epicyclic gear train 50 also includes an internally toothed crown 52 which is disposed within the casing of the starter motor 20, and which is formed by being molded on to the right hand (in FIG. 1) face of the support plate 12. A set of small through holes, consisting of a very large number of these holes distributed over a pitch circle around the central hole 44, serve for anchoring the crown 52 in place. The plastics material of the toothed crown 52 extends through the base plate 12 via these small holes, so as to form an equivalent number of tenons for anchoring the crown 52 to the base plate.

The plastics material extending through the small holes is continuous with a radial portion 56 of the crown 52. This radial portion 56 is molded against the left-hand radial face 13 (as seen in FIG. 1) of the base plate 12. The radial portion 56 constitutes an annular disc for the axial retention of the bush 46. It is extended over the face 13 radially outwardly by a connecting portion 58 which enables the crown 52 and the support member 36 to be made by molding them simultaneously on to the base plate 12 from a single charge of material injected into the mold. This charge fills the cavity of the mold that corresponds to the toothed crown 52, and then some of it penetrates indirectly, via the holes, the mold cavity in which the articulation support member 36 is thereby formed.

DISCUSSION OF THE INVENTION

An object of the present invention is to provide a novel design for an electric starter of the general type defined above under "Field of the Invention", but which overcomes the disadvantages discussed above.

To this end, according to the invention, such a starter is characterised in that the articulation support member and the toothed crown each consist of a separate component, with each of these components being formed in the mold from a separate charge of plastics material.

According to a preferred feature of the invention, the body of the articulation support member is extended by an anchor tenon which extends through a single through hole in the base plate, this single hole having a non-circular cross section.

According to another preferred feature of the invention, the annular body of the toothed crown extends through a set of apertures formed in the base plate and spaced apart in the circumferential direction about a hole in the base plate, with a shaft of the reduction gear train passing through this hole. This set of apertures preferably consists of apertures spaced apart at regular intervals; and each of these apertures is preferably in the form of an arcuate slot.

According to a further preferred feature of the invention, the number of these apertures is preferably not a multiple of the number of satellite gears in the epicyclic gear train.

Further features and advantages of the invention will appear more clearly from a reading of the detailed description of a preferred embodiment of the invention which follows, and which is given by way of example only and with reference to the accompanying drawings.

DESCRIPTION OF A PREFERRED EMBODIMENT OF THE INVENTION

Figure 3:
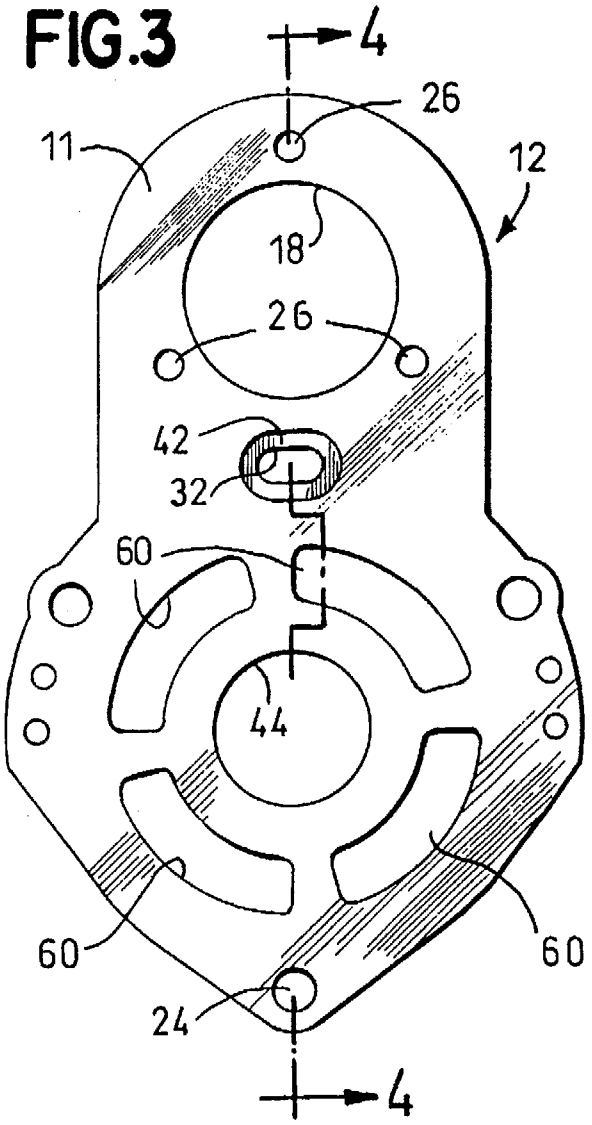
FIG. 3 is a view similar to FIG. 2, showing a base plate made in accordance with features of the present invention.
Figure 4:
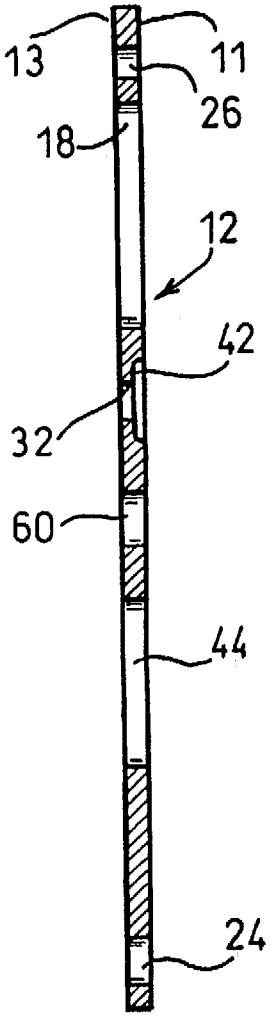
FIG. 4 is a view in cross section taken on the line 4—4 in FIG. 3.

In accordance with the invention, reference is now made to FIGS. 3 and 4, which show a preferred form of the novel design of base for an electric starter in a motor vehicle, in accordance with the present invention. In these Figures, those elements that are identical with elements shown in FIGS. 1 and 2 are given the same reference numerals.

Figure 5:
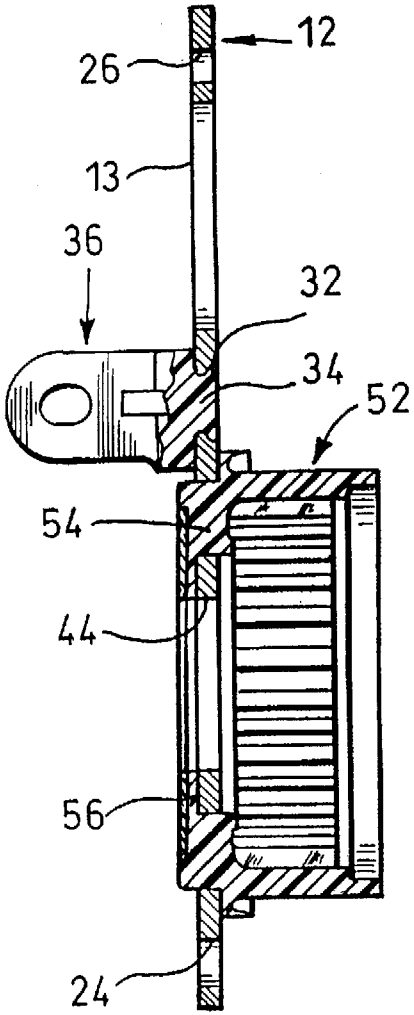
FIG. 5 is a view similar to that in FIG. 4, being a cross section on the line 5—5 in FIG. 6 and showing the base plate according to the invention after simultaneous application, by molding in place, of the articulation support member for the lever and the toothed crown.
Figure 7:
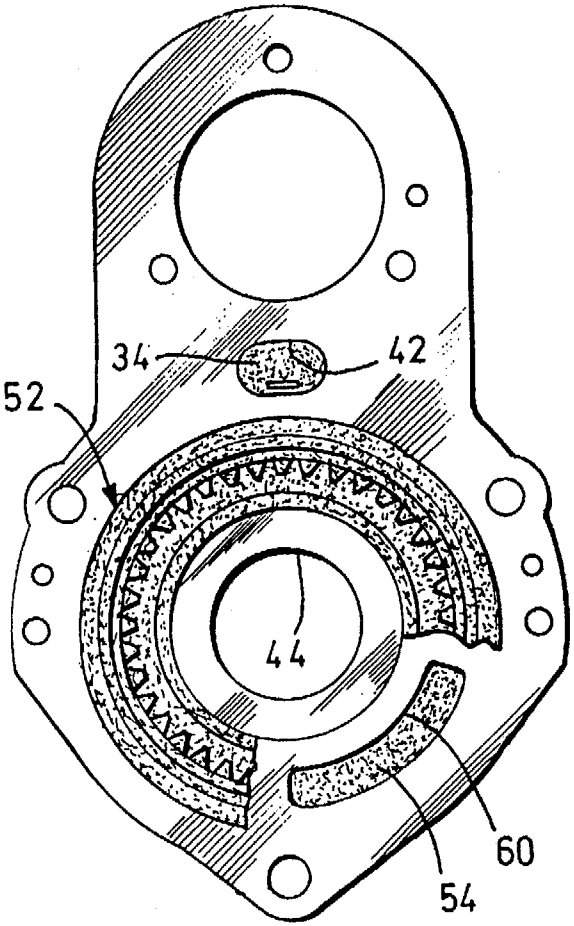
FIG. 7 is a side view, shown partly cut away, as seen from the right in FIG. 5.
Figure 6:
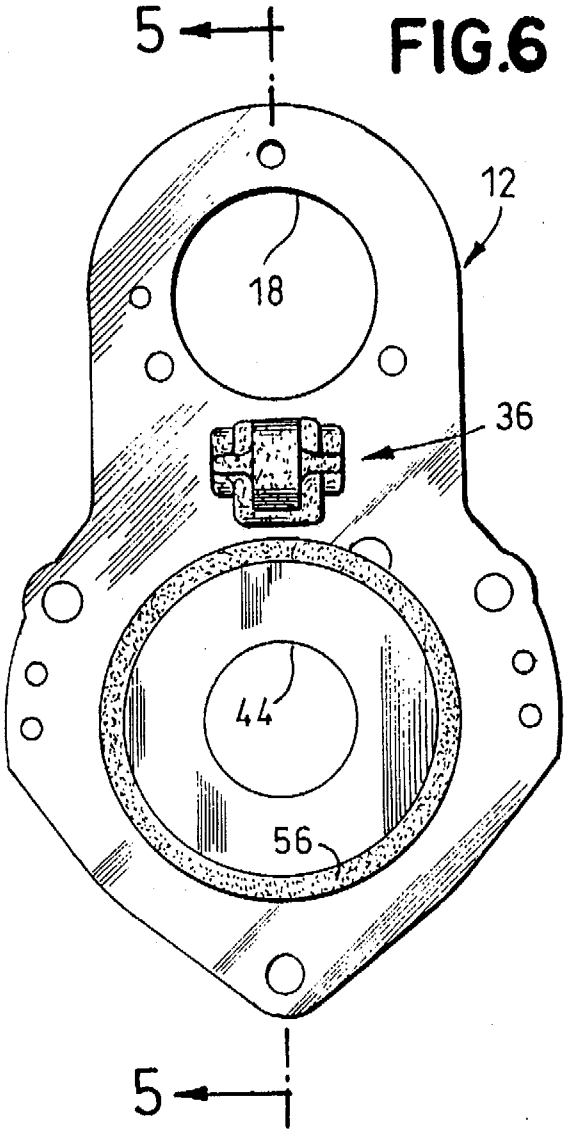
FIG. 6 is a side view, as seen from the left in FIG. 5.

As can be seen in FIGS. 3 and 4, the through hole 32, and an associated peripheral countersink 42, in which the tenon 34 (FIGS. 5 and 7 is formed for anchoring the articulation support member 36 to the base plate 12, is a hole having a non-circular cross section; and in this example it has an oval cross section. Further in this regard, the countersink 42 receives an upset portion of the tenon 34.

Four through apertures 60, in the form of arcuate slots, are spaced apart around the central hole 44 in the lower part of the base plate 12.

Figure 1:
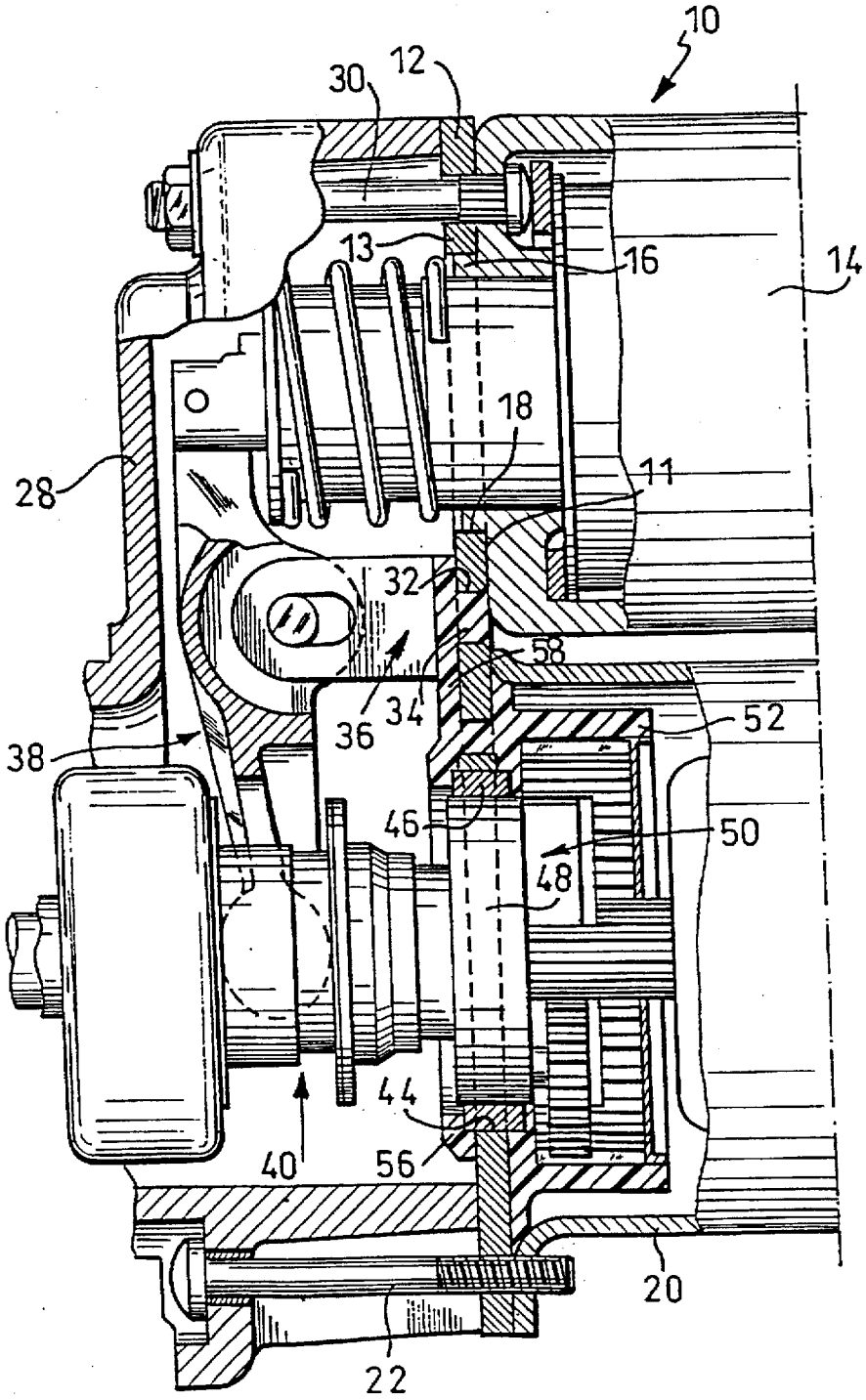
FIG.1 PRIOR ART
FIG. 1 is a view, in partial cross section taken on a plane passing through the axes of the contactor and the motor, showing part of a motor vehicle starter in accordance with the present state of the art.
Figure 2:
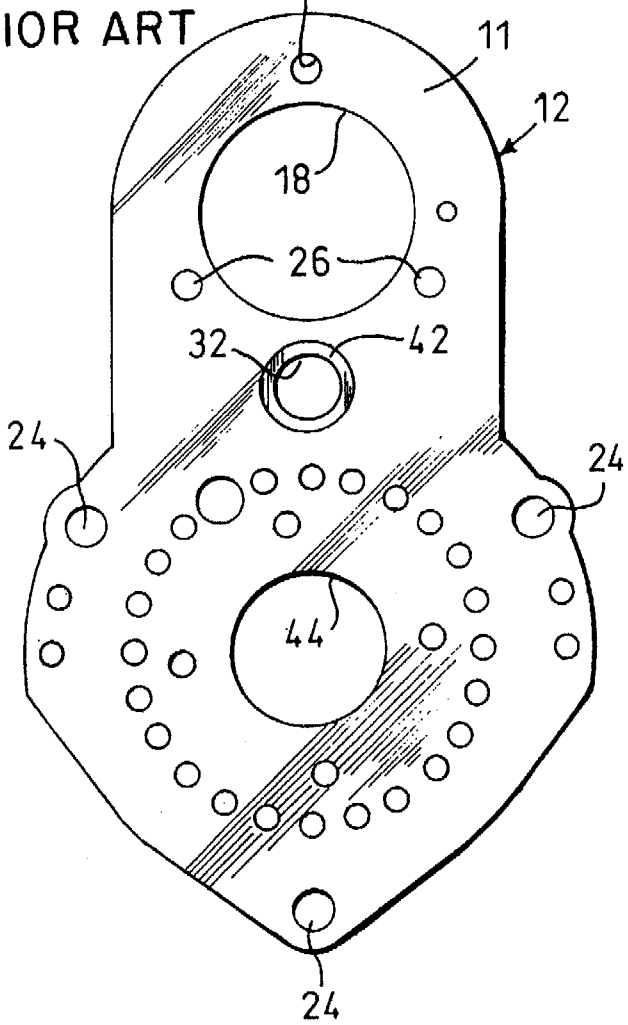
FIG.2 PRIOR ART
FIG. 2 is a side view, seen from the right in FIG. 1, of the base plate of the starter prior to the operation of molding the articulation support member and the toothed crown into place.

The central hole 44 receives the starter head 40 (FIG. 1). The apertures 60 are arranged at equal spacings on a common pitch circle centered on the hole 44. Each slot 60 subtends an angle of nearly 90 degrees at the center. Four heavy tenons 54 are formed through these slots (by molding on to the base plate 12), for anchoring the toothed crown 52 in place.

As can best be seen in FIG. 5, the articulation support member 36 and the toothed crown 52 are made as two separate elements, that is to say there is no continuity of material between these two components.

In this connection, the mold which is used for the molding operation to form the articulation support member 36 and toothed crown 52 (which is not shown in FIG. 5) has two separate feeds, for injection of two separate charges of plastics material. However, the operations of molding the two elements 36 and 32 are still carried out simultaneously in a single mold.

Because the cross section of the hole 32, for receiving the tenon 34 whereby the articulation support member 36 is anchored in place, is not circular, the support member 36 is prevented from rotating about its main axis.

The plastics material in which the toothed crown 52 is molded, and which passes through the apertures (FIG. 7) 60 to form the tenons 54, also extends over the left hand (in FIG. 5) radial face 13 of the base plate 12, again, to form an annular disc 56 which augments the anchorage of the toothed crown 52. A contractor body 14 has an annular collar portion 16 that is fitted into a circular hole 18 formed in the upper part of the base plate 12.

Preferably, the number of apertures 60, arranged regularly in the circumferential direction, is not a multiple of the number of satellite gears in the epicyclic gear train 50. In the example shown in the drawings, this number is three.

What is claimed is:

1. An electric starter for a motor vehicle engine having an electric motor with a motor casing; a contactor having a contactor body parallel to the electric motor; a base plate supporting the motor casing; an articulation support member having a support member body and being molded in plastics material on to the base plate; an actuating lever articulated on the support member; a starter head coupled to the actuating lever for actuation thereby, the starter head including a starter head shaft; and an epicyclic reduction gear train coupling the motor with the starter head shaft, the epicyclic reduction gear train including a crown having a crown body and defining internal teeth, the crown being molded in plastics material on to the base plate, the base plate having a plurality of through holes, with the support member body and the crown body each extending through at least a respective one of the through holes, the support member and the toothed crown both being separately anchored to the base plate, wherein the invention comprises the support member being molded on the base plate through a first charge of plastics material and the toothed crown being molded on the base plate with the support member from a corresponding separate charge of plastics material and as a component that is separate from the support member.

2. A starter according to claim 1, wherein one of the base plate through holes is non-circular an anchor tenon extending from the support member and through the non-circular through hole in the base plate in order to anchor the support member to the base plate and prevent rotation of the support member relative to the base plate.

3. A starter according to claim 1, wherein the epicyclic reduction gear train has a shaft extending through another of said through holes in the base plate, the base plate having apertures disposed in a circle about said another hole through which the reduction gear train shafts extends.

4. A starter according to claim 3, wherein said aperture disposed in a circle about said another of the through holes are arranged at regular intervals in said circle.

5. A starter according to claim 3, wherein each said aperture disposed about said another through hole is an arcuate slot.

6. A starter according to claim 3, wherein the epicyclic gear train has a first number of satellite gears, the number of said another through hole apertures in the base plate being other than a multiple of said number of said satellite gears.

* * * * *